US006722437B2

(12) United States Patent
Vercaemer et al.

(10) Patent No.: US 6,722,437 B2
(45) Date of Patent: Apr. 20, 2004

(54) TECHNIQUE FOR FRACTURING SUBTERRANEAN FORMATIONS

(75) Inventors: Claude Vercaemer, London (GB); Peter Allan Goode, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 31 days.

(21) Appl. No.: 10/127,093

(22) Filed: Apr. 22, 2002

(65) Prior Publication Data

US 2003/0075333 A1 Apr. 24, 2003

Related U.S. Application Data

(63) Continuation-in-part of application No. 10/013,114, filed on Oct. 22, 2001.

(51) Int. Cl.[7] ..... E21B 43/26

(52) U.S. Cl. ..... 166/308; 166/271; 166/90.1; 166/177.5

(58) Field of Search ..... 166/308, 271, 166/90.1, 177.5, 305.1

(56) References Cited

U.S. PATENT DOCUMENTS

| | | | | |
|---|---|---|---|---|
| 341,327 A | | 5/1886 | Fay | |
| 2,812,025 A | | 11/1957 | Teague et al. | |
| 3,297,092 A | | 1/1967 | Jennings | |
| 3,353,599 A | | 11/1967 | Swift | |
| 3,419,080 A | | 12/1968 | Lebourg | |
| 3,489,220 A | | 1/1970 | Kinley | |
| 3,669,190 A | * | 6/1972 | Sizer et al. | 166/387 |
| 3,746,091 A | * | 7/1973 | Owen et al. | 166/107 |
| 5,040,283 A | | 8/1991 | Pelgrom | |
| 5,348,095 A | | 9/1994 | Worrall et al. | |
| 5,366,012 A | | 11/1994 | Lohbeck | |
| 5,390,742 A | * | 2/1995 | Dines et al. | 166/297 |
| 5,513,703 A | * | 5/1996 | Mills et al. | 166/55.1 |
| 5,901,789 A | | 5/1999 | Donnelly et al. | |
| 6,029,748 A | | 2/2000 | Forsyth et al. | |
| 6,250,385 B1 | | 6/2001 | Montaron | |
| 6,253,850 B1 | | 7/2001 | Nazzai et al. | |
| 6,301,959 B1 | | 10/2001 | Hrametz et al. | |
| 6,302,199 B1 | | 10/2001 | Hawkins et al. | |
| 6,328,113 B1 | | 12/2001 | Cook | |

* cited by examiner

*Primary Examiner*—Roger Schoeppel
(74) *Attorney, Agent, or Firm*—Robert A. Van Someren; Jeffrey Griffin; Brigitte Jeffery Echols

(57) ABSTRACT

A technique for stimulating production of fluids from a subterranean formation. The technique utilizes a tubular member disposed within a wellbore. The tubular member comprises transverse openings that facilitate a formation fracturing process. Subsequent to fracturing, a completion element may be deployed within the tubular element. In some applications, the completion element is an expandable element.

29 Claims, 10 Drawing Sheets

TECHNIQUE FOR FRACTURING SUBTERRANEAN FORMATIONS

CROSS REFERENCE TO RELATED APPLICATIONS

The following is a continuation-in-part of U.S. application Ser. No. 10/013,114, filed on Oct. 22, 2001.

FIELD OF THE INVENTION

The present invention relates generally to technique for fracturing a formation to facilitate production of fluid, and particularly to the use of an expandable device deployed within a wellbore to facilitate the fracturing process.

BACKGROUND OF THE INVENTION

In the conventional construction of wells for the production of fluids, such as petroleum, natural gas and other fluids, a wellbore is drilled in a geological formation to a reservoir of the desired production fluids. In some formations, flow of the desired production fluid to the wellbore is inhibited by, for example, the structure and composition of the formation. In these situations, fracturing can be used to stimulate the production of fluid from the subterranean formation.

One type of fracturing is referred to as hydraulic fracturing in which a fracturing fluid is injected through a wellbore and against the face of the formation at a pressure and flow rate sufficient to overcome the minimum principal stress in the reservoir and thus propagate fractures in the formation. The fracturing fluid typically comprises a proppant, such as 20–40 mesh sand, bauxite, glass beads, etc., suspended in the hydraulic fracturing fluid. The fluid and proppant are transported into the formation fractures and function to prevent the formation from closing upon release of the pressure. The proppant effectively fills fractures to provide permeable channels through which the formation fluids can flow to the wellbore for production.

In some applications, fracturing treatments are difficult or not feasible. For example, when certain types of completions are to be placed in a wellbore, the fracturing treatments would need to be run before the installation of the completions. In other words, the fracturing treatments would need to be carried out in an open-hole configuration. This approach, however, is difficult particularly in weak formations. If a fracturing treatment is carried out, the weak formation can result in a filled or partially filled wellbore that blocks installation of the completion.

SUMMARY OF THE INVENTION

The present invention relates generally to a technique that facilitates fracturing in a variety of applications. The technique is particularly amenable to use in application where a completion, such as a sand screen or filter is to be run to a desired location within the wellbore. The technique utilizes a tubular that is placed in the wellbore at a region to undergo a fracturing treatment. The tubular has a plurality of transverse openings that permit the transfer of pressure and fluid from inside the tubular to the formation. According to one embodiment, the tubular is inserted into the wellbore in a contracted state and then expanded radially towards the wellbore wall.

BRIEF DESCRIPTION OF THE DRAWINGS

The invention will hereafter be described with reference to the accompanying drawings, wherein like reference numerals denote like elements, and.

DETAILED DESCRIPTION OF EXEMPLARY EMBODIMENTS

The present technique utilizes a technique for fracturing a formation through transverse openings in a tubular member that may be introduced into a variety of subterranean environments. Typically, the tubular member is deployed along a wellbore while in a reduced or contracted state. The tubular member is then expanded against the formation at a desired location to permit fracturing of the formation through the transverse openings. Subsequent to fracturing, a final completion sometimes referred to as a completion string, having a full size diameter may be inserted into the tubular member.

Figure 1:
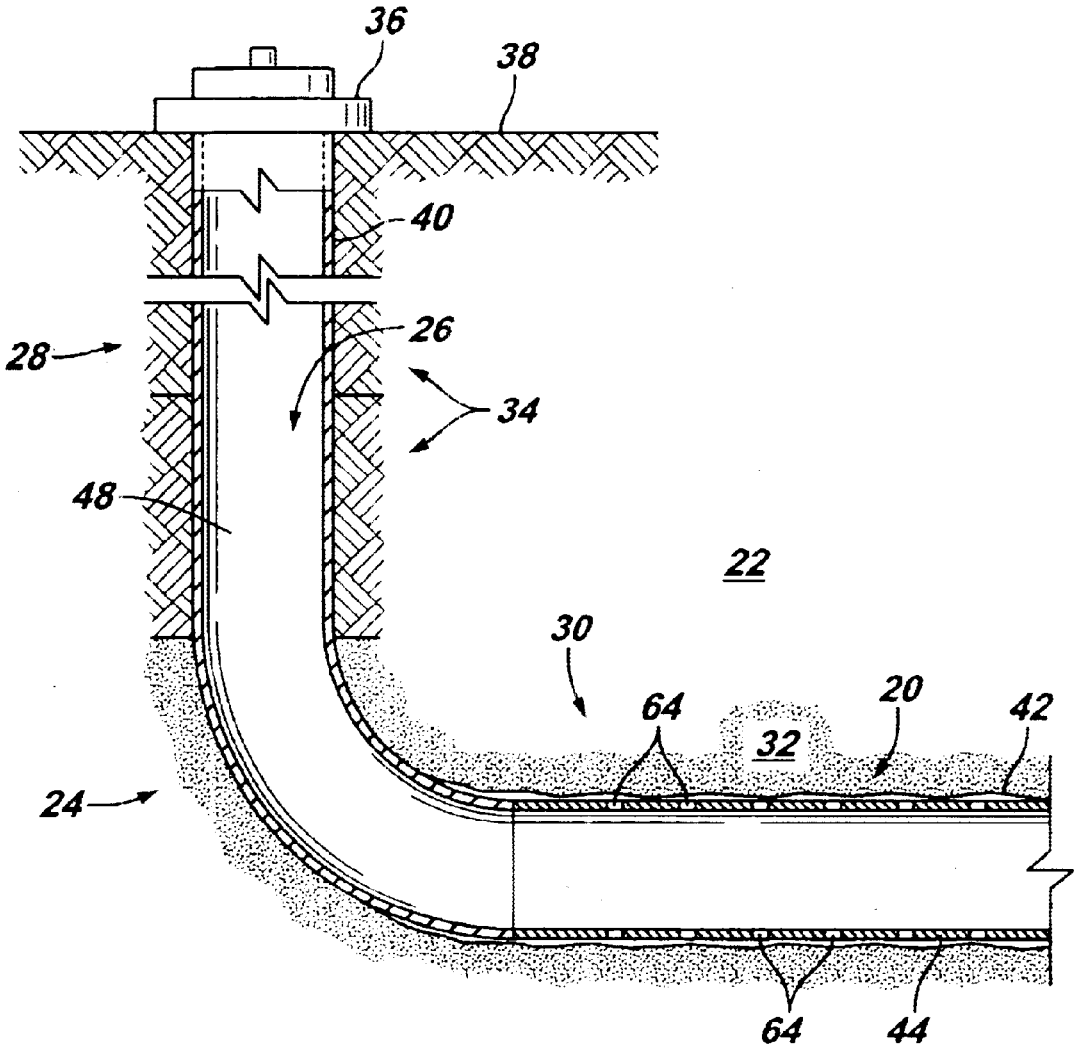
FIG. 1 is a front elevational view of an exemplary tubular member disposed within a wellbore.

Referring generally to FIG. 1, an exemplary tubular member 20 is illustrated in an expanded state deployed in a subterranean formation 22. In the illustrated embodiment, the tubular member 20 is utilized in a reservoir 24 accessed by a wellbore 26. The exemplary wellbore 26 comprises a generally vertical section 28 and a lateral section 30. However, wellbore 26 also can be solely vertical. Tubular member 20 can be placed at a variety of locations along wellbore 26, but an exemplary location is in a production zone 32 to facilitate the flow of desired production fluids into wellbore 26. Typically, non-reservoir regions 34 also exist in subterranean formation 22.

In many applications, wellbore 26 extends into subterranean formation 22 from a wellhead 36 disposed generally at a formation surface 38. The wellbore extends through subterranean formation 22 to production zone 32. Furthermore, wellbore 26 typically is lined with one or more other tubular sections 40, e.g. one or more liners.

Typically, tubular member 20 is disposed in an openhole region 42 of wellbore 26 subsequent to or intermediate tubular sections 40. Thus, when tubular member 20 is expanded, e.g. deformed to its expanded state, a tubular member sidewall 44 is effectively moved radially outwardly, reducing the annular space between member 20 and the formation in open-hole region 42. In one typical application, tubular member 20 is expanded outwardly to abut against the formation, thereby minimizing annular space as more fully described below.

Figure 2:
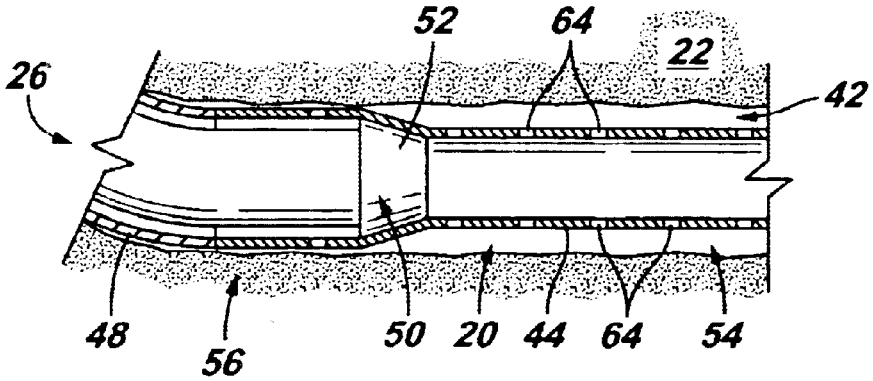
FIG. 2 is a front elevational view of the tubular member of FIG. 1 being expanded at a desired location.

Expansion of member 20 at the desired production zone can be accomplished in several different ways. For example, tubular member 20 may be coupled to a deployment tubing 48, e.g. coiled tubing, by an appropriate coupling mechanism 50, as illustrated in FIG. 2. An exemplary coupling mechanism 50 comprises a sloped or conical lead end 52 to facilitate radial expansion of tubular member 20 from a contracted state 54 (see right side of tubular member 20 in FIG. 2) to an expanded state 56 (see left side of FIG. 2). As the sloped lead end 52 is moved through tubular member 20, the entire member is changed from the contracted state 54 to the expanded state 56. Other coupling mechanisms also may be utilized to expand tubular 20, such as bicenter rollers. Expansion also can be accomplished by pressurizing the tubular member 20 or by relying on stored energy within member 20.

Figure 3:
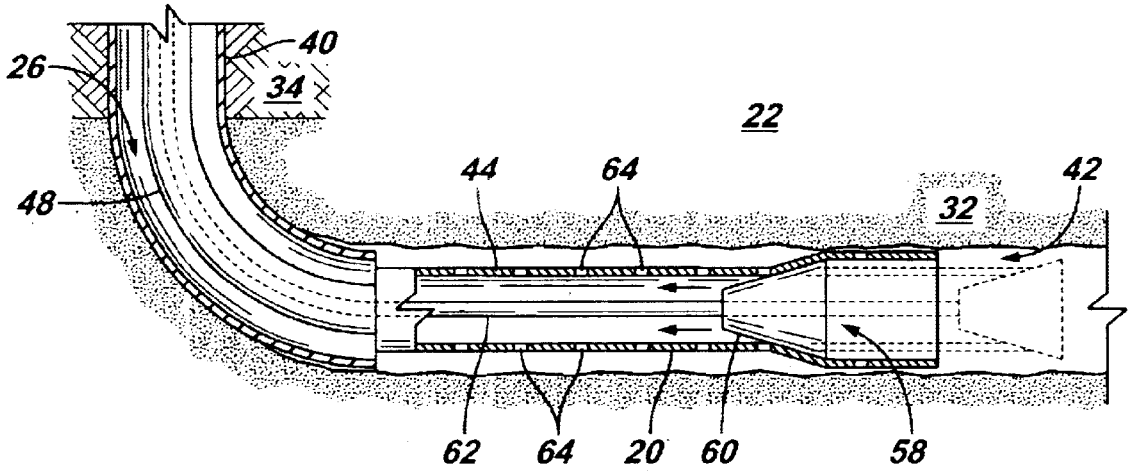
FIG. 3 is a front elevational view similar to FIG. 2 but showing an alternate technique for expansion.

In an alternate embodiment, as illustrated in FIG. 3, tubular member 20 is delivered to a desired location within the wellbore during an initial run downhole via deployment tubing 48. The expandable member 20 is mounted between deployment tubing 48 and a spreader mechanism 58 disposed generally at the lead end of member 20. Spreader mechanism 50 has a conical or otherwise sloped lead surface 60 to facilitate conversion of tubular 20 from its contracted state to its expanded state. As illustrated in FIG. 3, spreader mechanism 58 is pulled through the interior of member 20 by an appropriate pulling cable 62 or other mechanism. Once spreader mechanism 58 is pulled through, the spreader mechanism 58 is retrieved through wellbore 26.

Figure 4:
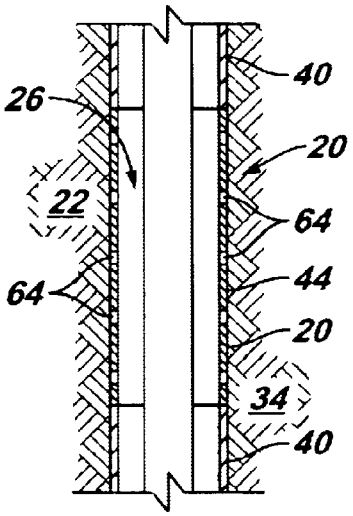
FIG. 4 is a front elevational view of an expanded tubular member.
Figure 5:
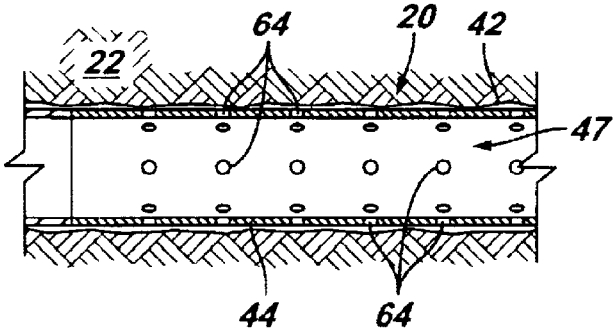
FIG. 5 is a front elevational view of an expanded tubular member having multiple expanded openings for fluid flow therethrough.

Tubular member 20 may be formed in a variety of sizes, shapes, cross-sectional configurations and wall types and placed at a variety of locations. For example, tubular member sidewall 44 may be located between liner sections 40, as illustrated in FIG. 4. The tubular member 20 further comprises a plurality of flow passages 64, as best illustrated in FIG. 5. Flow passages 64 permit pressure and fluid, such as fracturing and/or production fluid, to flow transversely through tubular member 20 between wellbore 26 and formation 22. Illustrated flow passages 64 are radially oriented, circular openings, but they are merely exemplary passages and a variety of arrangements and configurations of the openings can be utilized. Additionally, the density and number of openings can be adjusted for the specific application.

Figure 6:
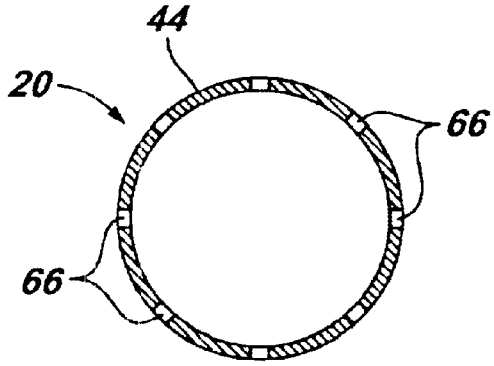
FIG. 6 is a cross-sectional view of an exemplary tubular member.
Figure 7:
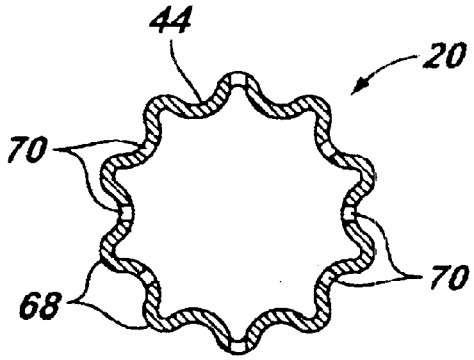
FIG. 7 is a cross-sectional view illustrating an alternate embodiment of the tubular member.
Figure 8:
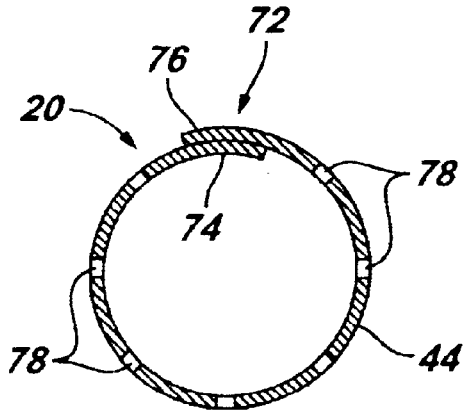
FIG. 8 is a cross-sectional view illustrating another alternate embodiment of the tubular member.

The expandability of tubular member 20 may be achieved in a variety of ways. Examples of cross-sectional configurations amenable to expansion are illustrated in FIGS. 6, 7 and 8. As illustrated specifically in FIG. 6, the tubular member sidewall 44 comprises a plurality of slots 66 that expand and become flow passages 64, e.g. radial flow passages, upon expansion. In this embodiment, slots 66 are formed along the length of tubular member 20 and upon deforming of tubular member 20, slots 66 are stretched into broader openings. The configuration of slots 66 and the resultant openings 64 may vary substantially. For example, the contracted openings may be in the form of slots, holes or a variety of geometric or asymmetric shapes.

In an alternate embodiment, sidewall 44 is formed as a corrugated or undulating sidewall, as best illustrated in FIG. 7. The corrugation allows tubular member 20 to remain in a contracted state during deployment. However, after reaching a desired location, an appropriate expansion tool is moved through the center opening of the tubular member forcing the sidewall to a more circular configuration. This deformation again converts the tubular member to an expanded state. The undulations 68 typically extend along the entire circumference of sidewall 44. Additionally, a plurality of slots or other openings 70 are formed through sidewall 44 to permit fluid flow and pressure application through side wall 44.

Another exemplary embodiment is illustrated in FIG. 8. In this embodiment, sidewall 44 comprises an overlapped region 72 having an inner overlap portion 74 and an outer overlap portion 76. When outer overlap 76 lies against inner overlap 74, the tubular member 20 is in its contracted state for introduction through wellbore 26. Upon placement of the tubular member at a desired location, an expansion tool is moved through the interior of expandable member 20 to expand the sidewall 44. Essentially, inner overlap 74 is slid past outer overlap 76 to permit formation of a generally circular, expanded tubular 20. As with the other exemplary embodiments, this particular embodiment may comprise a plurality of slots or other openings 78 to permit the flow of fluids through sidewall 44.

Figure 8A:
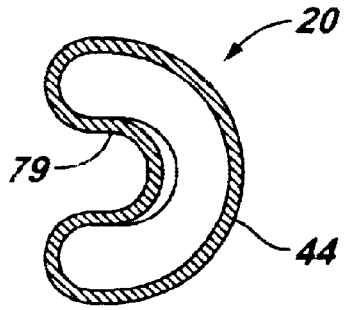
FIG. 8A is a cross-sectional view illustrating another alternate embodiment of the tubular member.

In FIG. 8A, another embodiment is illustrated in which a portion 79 of sidewall 44 is deformed radially inward in the contracted state to form a generally kidney-shaped cross-section. When this tubular member is expanded, portion 79 is forced radially outward to a generally circular, expanded configuration.

Regardless of the design of tubular member 20 and sidewall 44, transverse flow passages 64 permit the fracturing of formation 22 by exposing formation 22 to fracturing pressure via flow passages 64 when wellbore 26 is pressurized. As described more fully below, flow passages 64 also permit the flow of proppant between the wellbore interior and the formation.

In the following description, a variety of fracturing techniques are described for fracturing one or more formations or regions of formation. The fracturing techniques utilize one or more tubular members 20 to facilitate fracturing of the formation. In a typical application, the tubular member 20 is expandable to permit movement of the member to a desired wellbore location in a contracted state whereupon the tubular member 20 is expanded radially outward towards the wellbore wall.

Figure 9:
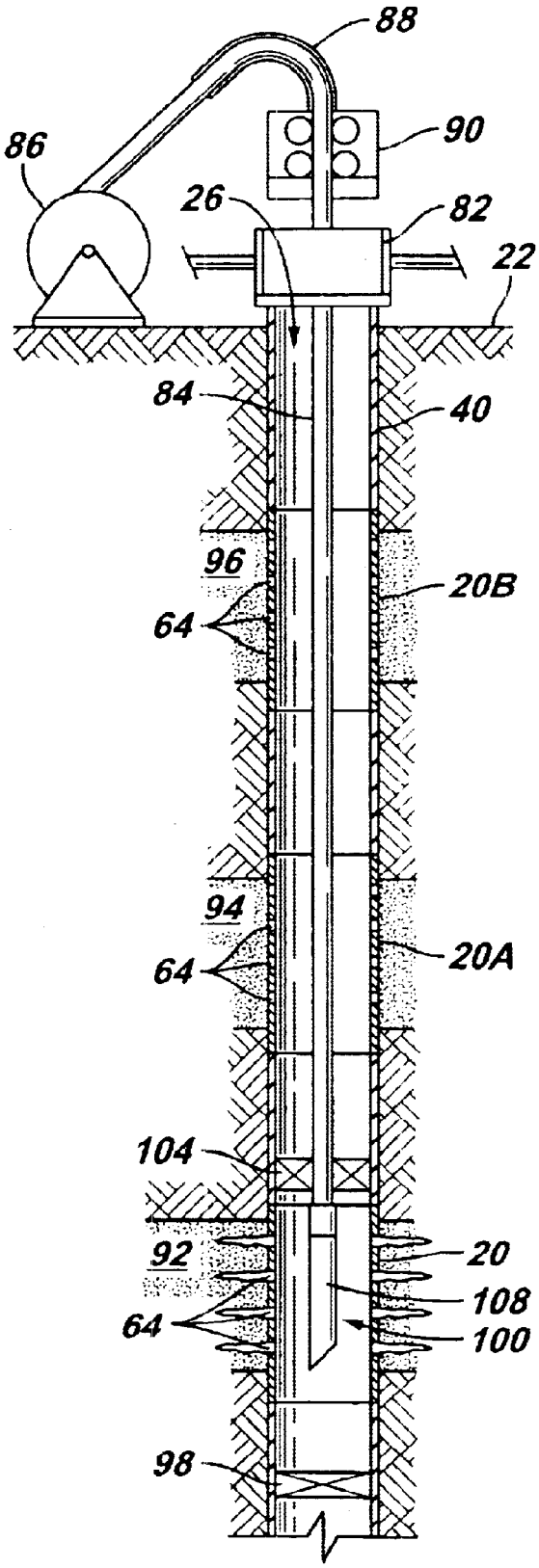
FIG. 9 is a schematic view of a multiple production zone wellbore illustrating coiled tubing suspending a bottom hole assembly for hydraulic fracturing of each of the production zones in sequence from the lowermost production zone to the uppermost production zone and showing the bottom hole assembly in position for hydraulic fracturing of the lowermost zone.

As illustrated in FIG. 9, an exemplary wellbore 26 is formed in formation 22 and is connected to a wellhead 82. A coiled tubing string 84 is wound on a reel 86 and extends from reel 86 over a gooseneck 88 to an injector 90 positioned over wellhead 82 for injecting the coiled tubing string 84 through wellhead 82, as known to those of ordinary skill in the art. The exemplary formation 22 has a plurality of spaced production zones including a lowermost zone 92, an intermediate zone 94, and an uppermost zone 96. Zones 92, 94, and 96 are formed of an earth material having a high permeability, e.g. in excess of 50 millidarcy. A bridge plug 98 is positioned in wellbore 26 below lowermost production zone 92. A tubular member 20 is deployed, e.g. expanded, at each zone 92, 94 and 96 and can be labeled as members 20, 20A and 20B, respectively, from lowest to uppermost. It should be noted that although this particular fracturing process is conducted in three zones, the present technique applies to the fracturing of other numbers of zones including the single zone illustrated in FIG. 1. Furthermore, although coiled tubing is utilized in the exemplary embodiment described herein, other types of tubing may be employed for fracturing of the formation.

In this example, coiled tubing string 84 has a bottom hole assembly generally indicated at 100. Bottom hole assembly 100 is suspended within an expandable tubular member 20 adjacent the lowermost production zone 92. The assembly is arranged for hydraulically fracturing lowermost production zone 92 through openings 64 of tubular member 20.

Figure 10:
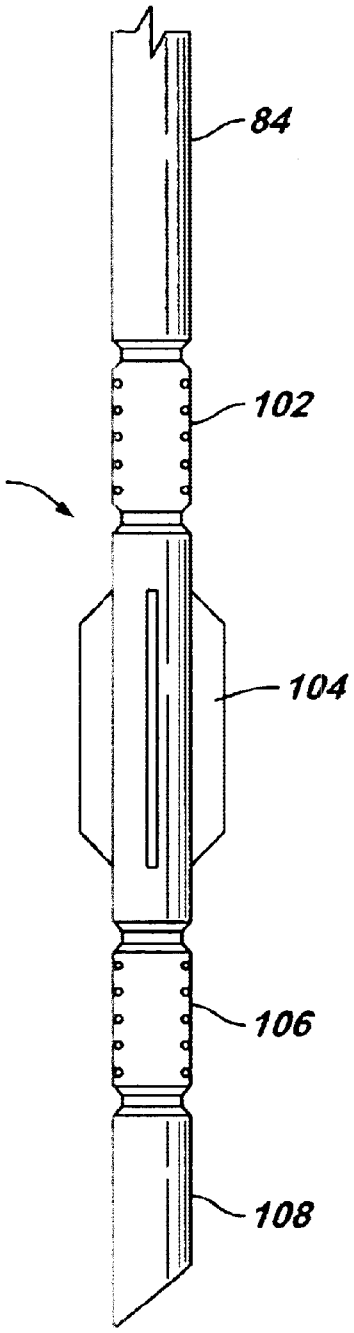
FIG. 10 is an elevational view of a suitable bottom hole assembly suspended from the coiled tubing for hydraulic fracturing of the production zones.

With reference to FIG. 10, bottom hole assembly 100 comprises a grapple connector 102 connected to tubing string 84 and a tension set packer indicated at 104. A tail pipe connector 106 is connected to packer 104 and a tail pipe 108 extends downwardly from tail pipe connector 106. Once exemplary tension set packer that can be utilized is a Baker Model AD1 packer sold by Baker Hughes, Inc., of Houston, Tex. Packer 104 is shown schematically in set position above the upper end of lowermost production zone 92 in FIG. 10 and end tail pipe 108 extends downwardly therefrom. Low friction fracturing material in the form of a slurry is discharged from tail pipe 108 at a predetermined pressure and volume for flowing into the permeable formation transversely through tubular member 20.

Figure 11:
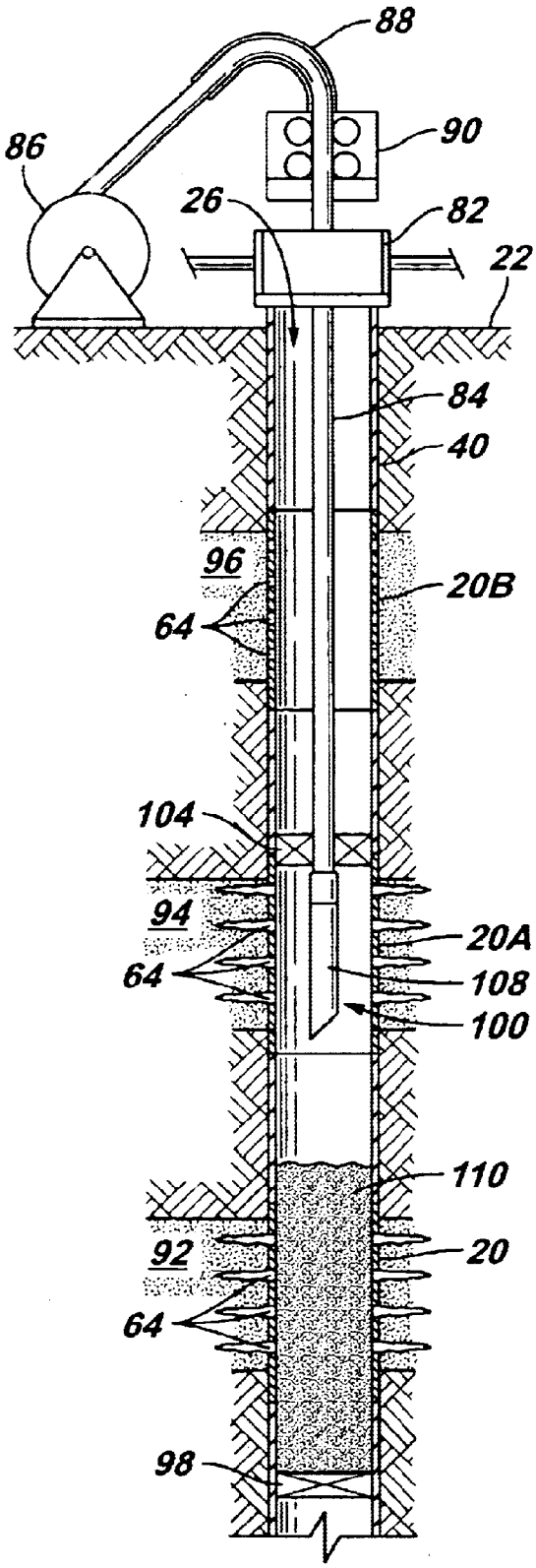
FIG. 11 is a schematic view similar to FIG. 9 but showing the bottom hole assembly in position for hydraulic fracturing of the second production zone from the bottom of the wellbore with a sand plug within the well bore covering the transverse openings in the fractured lowermost production zone.

After production zone 92 has been fractured with the predetermined low friction fracturing material and stabilized with a predetermined amount of the fracturing material, the slurry system is switched to a flush position and sufficient sand is added to form a sand plug in wellbore 26. The pumping system is then shut down, and the sand settles to form a sand plug, as illustrated at 110 in FIG. 11. Sand plug 110 lies across the openings 64 of tubular member 20.

After determining that sand plug 110 is in place, packer 104 is released and bottom hole assembly 100 is raised or pulled to the next production zone 94. Packer 104 is then set at a position above the uppermost tubular member 20B. The process is then repeated for production zone 94. The sand plug 110 for each production zone 92, 94, 96 is sufficient to cover the openings 64 of each tubular member for isolation of each of the production zones. Typically, the sand plug is formed at the end of the fracturing process by increasing the sand concentration in the slurry to provide the desired sand plug. After the pump is shut down, the sand settles to form the sand plug across the adjacent openings.

Figure 12:
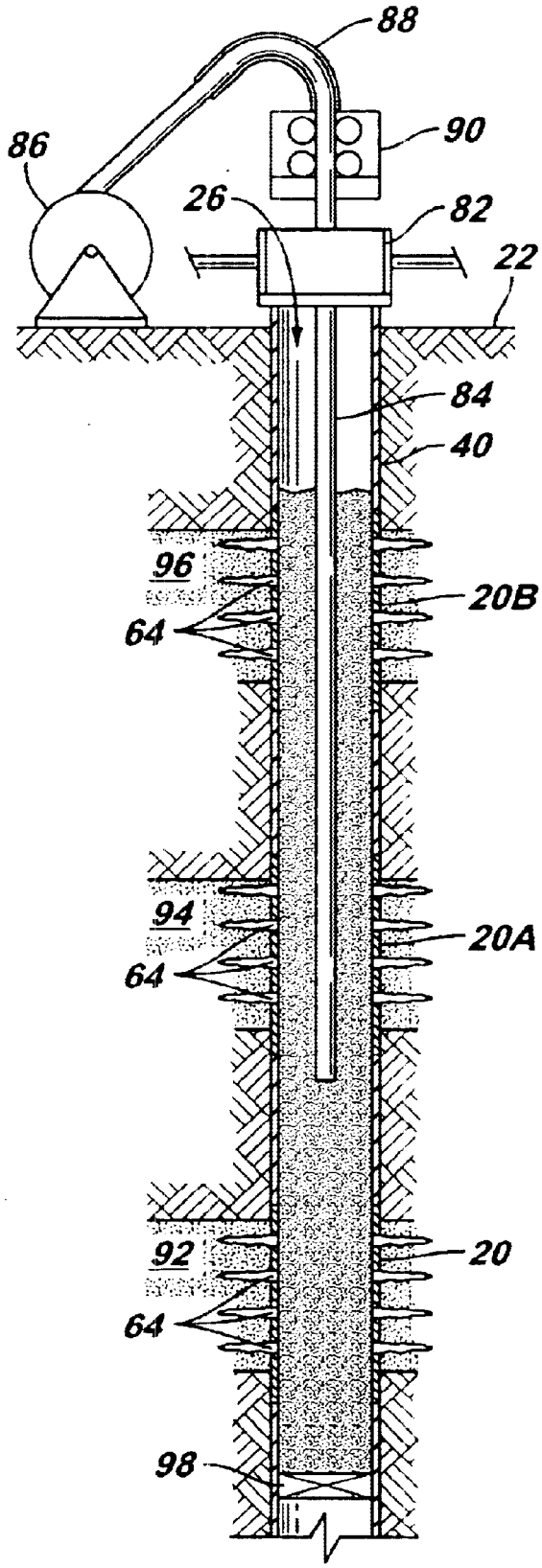
FIG. 12 is a schematic view of the wellbore shown in FIGS. 9 and 11 with the fracturing operation completed and sand within the wellbore being washed out for production.

After providing the sand plug for production zone 94, the tension packer 104 is released and the bottom hole assembly 100 is raised to the next production zone 96 for a repeat of the process. Any number of production zones may be hydraulically fractured by the present process. For the uppermost production zone, an upper mechanical packer may not always be necessary as a hanger may be provided for wellhead 82 to seal the annulus, as illustrated in FIG. 12. After the fracturing process is completed, the coiled tubing assembly is removed from wellbore 26. The sand in the wellbore may then be removed by another coiled tubing unit using air or water to wash the sand from the borehole as illustrated in FIG. 12.

Figure 13:
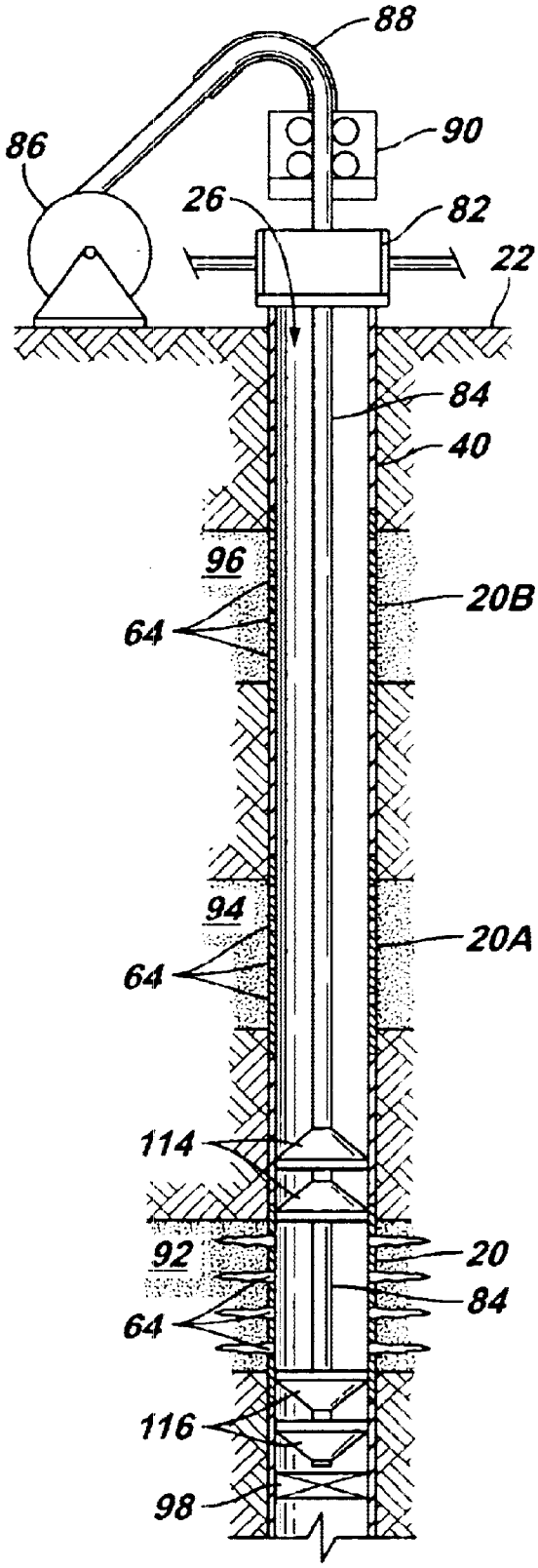
FIG. 13 is a schematic view of another embodiment of the invention in which the coiled tubing fracturing process utilizes upper and lower swab cups for isolating each of the production zones in sequence from the lowermost production zone.

In another embodiment of the fracturing technique, illustrated in FIG. 13, each production zone 92, 94, 96 is isolated individually by opposed swab cups mounted on the coiled tubing string 84. A pair of inverted downwardly projecting swab cups 114 are mounted on coiled tubing string 84 for positioning above the upper side of production zone 92, and a pair of upwardly directed swab cups 56 are mounted on coiled tubing string 84 for positioning below the lower side of production zone 92. Swab cups 114, 116 need not be released and set for each movement from one zone to another to isolate each zone individually. This facilitates movement of the swab cups from one zone to another in a minimum of time simply by raising of tubing string 84. A suitable bottom hole assembly 118 is provided between upper and lower swab cups 114, 116 for discharge of the fracturing material into the adjacent formation.

In one embodiment, lower swab cups 116 are spaced from upper swab cups 114 a distance at least equal to the thickness of the production zone having the greatest thickness. Thus, the distances between swab cups 114 and swab cups 116 do not have to be adjusted upon movement from one zone to another. Exemplary swab cups for use with the present invention are sold by Progressive Technology of Langdon, Alberta, Canada.

Figure 14:
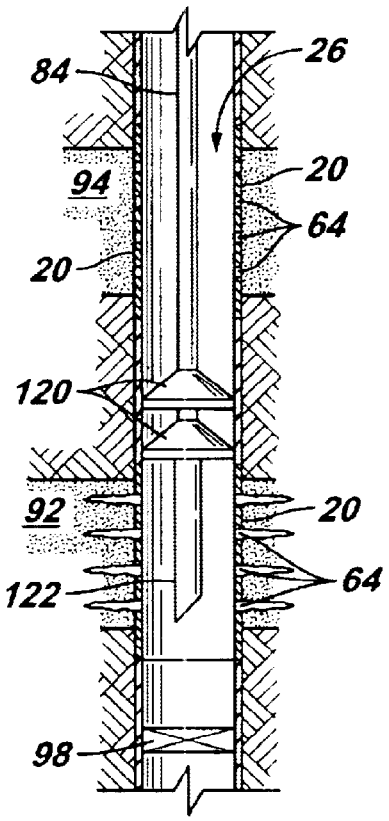
FIG. 14 is a schematic view of a further embodiment of the invention in which the coiled tubing fracturing process utilizes only upper swab cups for isolation of a production zone with a sand plug utilized for isolating the lower end of the zone after hydraulic fracturing.

As shown in the embodiment of FIG. 14, coiled tubing string 84 has a pair of inverted downwardly directed upper swab cups 120 mounted thereon for positioning above the upper side of production zone 92. A bottom hole assembly 122 extends downwardly from upper swab cups 120. A sand plug is utilized for isolation of the lower side of production zone 92 as in the embodiment shown in FIGS. 9–12. Coiled tubing 84 and swab cups 120 may be easily moved to the next superjacent zone without any release or setting of a packer.

Figure 15:
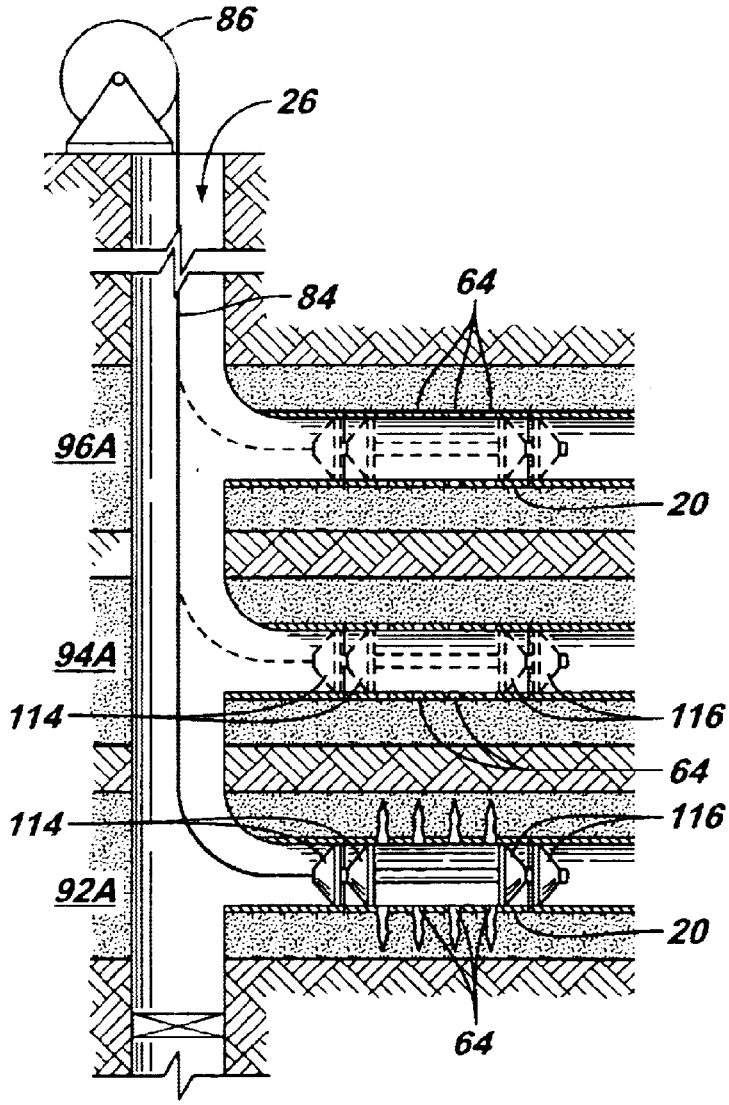
FIG. 15 is a schematic view of a further embodiment illustrating the coiled tubing fracturing process for a plurality of lateral bore portions extending to production zones from a single vertical borehole.

As illustrated in FIG. 15, the fracturing technique can be used in a borehole having one or more horizontally extending borehole portions defining production zones 92A, 94A, and 96A. Appropriate tubulars 20, e.g. expandable tubulars, are placed at desired locations in each of the production zones 92A, 94A, and 96A. Typically, zones 92A, 94A, and 96A are hydraulically fractured in sequence. Innermost swab cups 114 and outermost swab cups 116 are mounted about coiled tubing 84. While outermost swab cups 116 are shown mounted on coiled tubing 84, it may be desirable to provide a sand plug in lieu of those outermost swab cups as illustrated in FIG. 14.

The present technique may be used to fracture a formation having one or more separate production zones. In some instances, it may be desirable to provide hydraulic fracturing for a selected one of a plurality of available production zones if, for example, a production zone was previously bypassed. Also, selected fracturing might be provided for multiple lateral wells such as those illustrated in FIG. 15.

Although a variety of fracturing processes may be utilized, the exemplary technique describe herein is a hydraulic fracturing technique that uses a hydraulic fracturing fluid. Various fracturing fluids are available and known to those of ordinary skill in the art. Depending on the application, different types of fracturing fluids may be described, e.g. a variety of different types of additives or ingredients may be combined. For example, certain fiber-base additives are used to control proppant flow back from a hydraulic fracture during production. Such additives also can be used to reduce surface pressure during injection.

Another exemplary fracturing fluid comprises a visco elastic surfactant (VES) fluid. Other exemplary fracturing fluids comprise Xanthan-polymer-based fluids and fluids having synergistic polymer blends. Such fracturing fluids tend to have lower friction to facilitate use with coiled tubing.

With the use of one or more tubular members 20, a variety of completions can be moved downhole and located within the appropriate tubular member. In other words, upon completion of the fracturing of formation 22, the fracturing assembly is withdrawn from wellbore 26, and an appropriate completion is moved downhole to a desired location within the tubular member.

Figure 16:
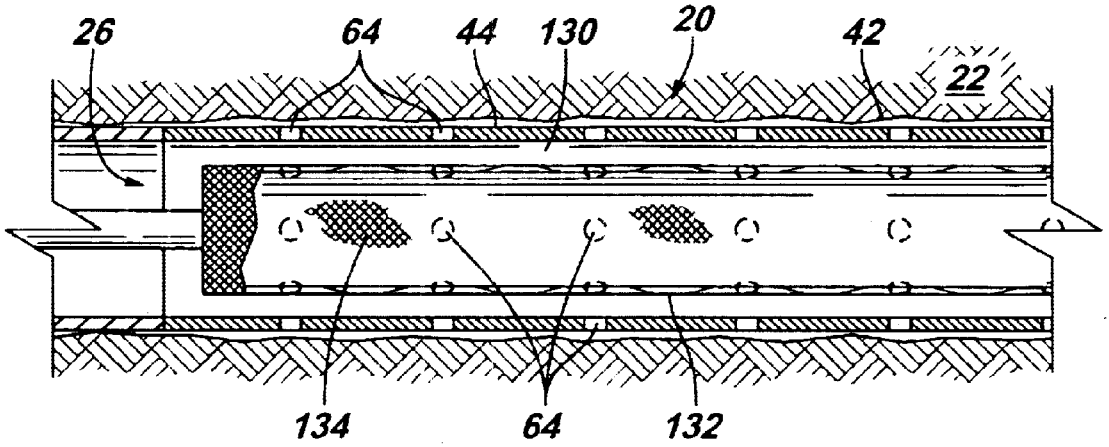
FIG. 16 is a front elevational view of a tubular member having a sand screen completion element disposed therein subsequent to fracturing the formation.

Many types of final completions can be used in the present technique. For example, various tubular completions, such as liners and sand screens may be deployed within an interior 130 of the expanded tubular member 20 which can function as an insertion guide for the completion. In FIG. 16, a completion 132, such as a sand screen, is illustrated within interior 130. The sand screen completion generally comprises a filter material 134 able to filter sand and other particulates from incoming fluids prior to production of the fluids. Because of the expandable tubular member, the sand screen 132 may have a full size diameter while retaining its ability to be removed from the wellbore. Additionally, the risk of damaging sand screen 132 during installation is minimized, and the most advanced filter designs can be inserted because there is no requirement for expansion of the sand screen itself.

Also, completion 132 may itself be an expandable completion. In this embodiment, the completion 132 typically is moved into interior 130 of tubular member 20 and expanded radially via an expansion mechanism as described above. One example of an expandable completion is an expandable sand screen.

Figure 17:
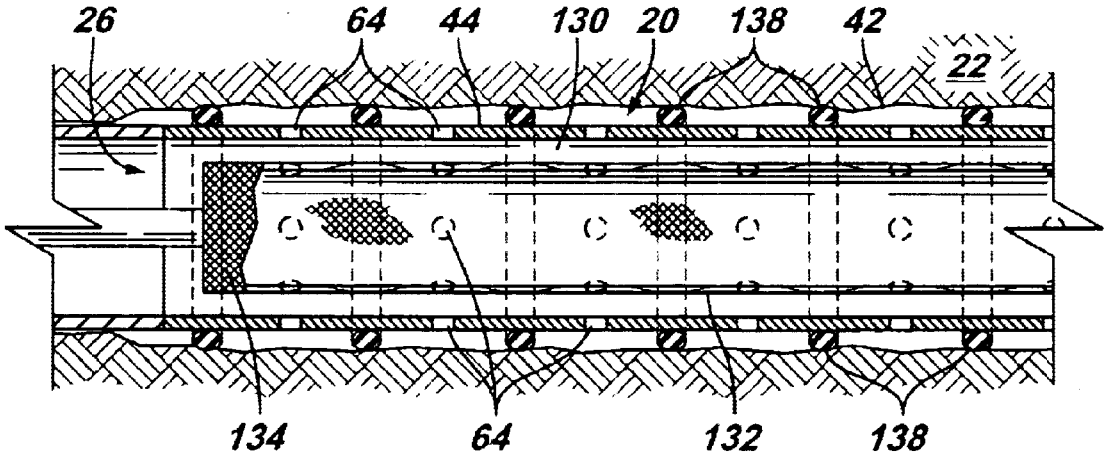
FIG. 17 is a front elevational view of a tubular member having an external axial flow inhibitor.

In some environments, it may be desirable to compartmentalize a given production zone, e.g. zone 32 or zone 92 along tubular member 20. This can be accomplished by inhibiting axial flow internally and/or externally of tubular member 20. For example, if the fracturing technique permits, axial flow inhibitors can be placed between tubular member 20 and formation 22 before fracturing or after. As illustrated in FIG. 17, an axial flow inhibitor 136 is combined with tubular 20. Axial flow inhibitor 136 is designed to act between tubular member sidewall 44 and geological formation 22, e.g., the open-hole wall of wellbore 26 proximate tubular 20. Inhibitor 136 limits the flow of fluids in an axial direction between sidewall 44 and formation 22 to allow for better sensing and/or control of a variety of reservoir parameters, as discussed above.

In the embodiment illustrated, axial flow inhibitor 136 comprises a plurality of seal members 138 that extend circumferentially around member 20. Seal members 138 may be formed from a variety of materials including elastomeric materials, e.g. polymeric materials injected through sidewall 44. Additionally, seal members 138 and/or portions of sidewall 44 can be formed from swelling materials that expand to facilitate compartmentalization of the reservoir. In fact, tubular member 20 may be made partially or completely of swelling materials that contribute to a better isolation of the wellbore. Also, axial flow inhibitor 136 may comprise fluid based separators, such as Annular Gel Packs availablefromSchlumbergerCorporation,elastomers,baffles, labyrinth seals or mechanical formations formed on the tubular member itself.

Figure 18:
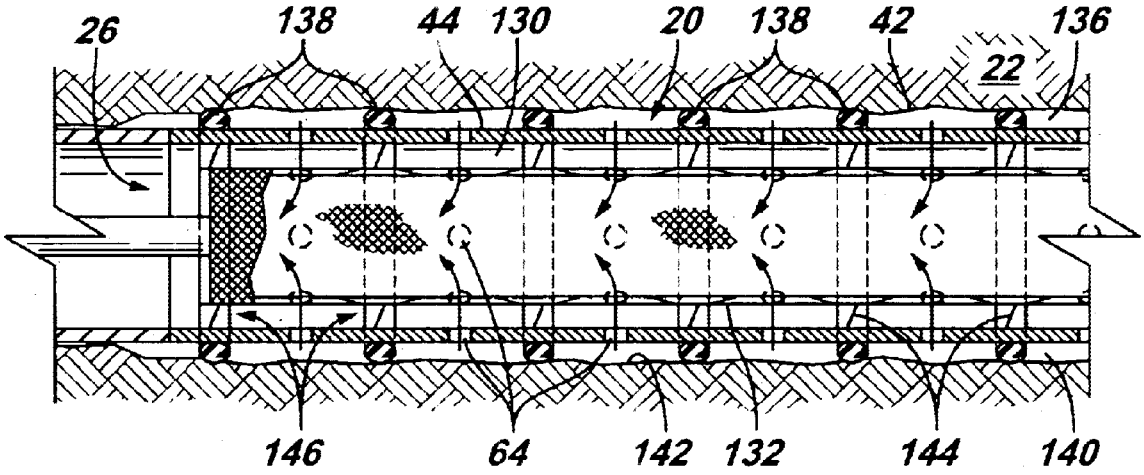
FIG. 18 is a view similar to FIG. 17 but showing an internal axial flow inhibitor.

Additionally or in the alternative, an internal axial flow inhibitor 140 can be deployed to extend radially inwardly from an interior surface 142 of tubular member sidewall 44, as illustrated in FIG. 18. An exemplary internal axial flow inhibitor comprises a labyrinth 144 of rings, knobs, protrusions or other extensions that create a tortuous path to inhibit axial flow of fluid in the typically small annular space between interior surface 142 of member 20 and the exterior of the completion, e.g. sand screen 132. In the embodiment illustrated, labyrinth 144 is formed by a plurality of circumferential rings 146. However, it should be noted that both external axial flow inhibitor 136 and internal axial flow inhibitor 140 can be formed in a variety of configurations and from a variety of materials depending on desired design parameters for a specific application.

Figure 19:
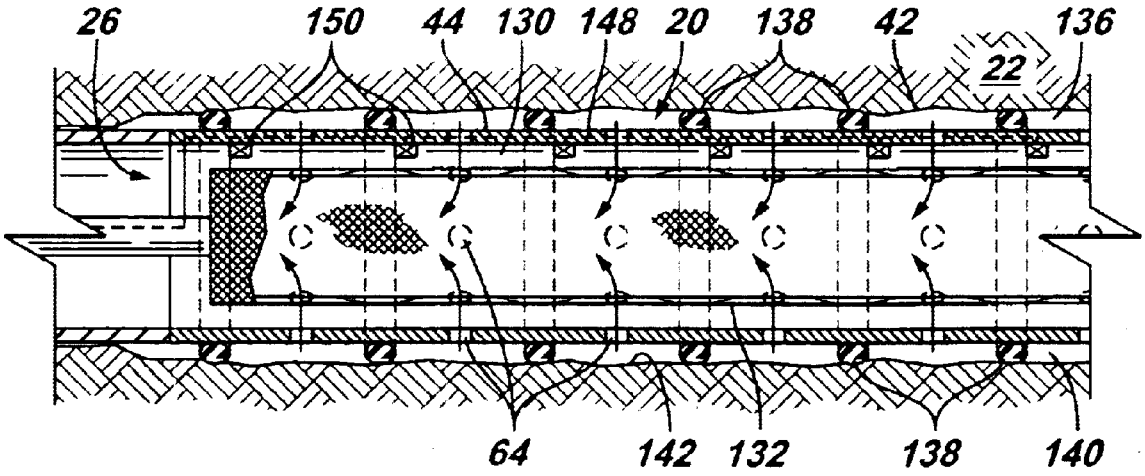
FIG. 19 illustrates a tubular member having one or more signal communication leads as well as one or more tools, e.g. sensors, incorporated therewith.

Tubular member 20 also may be designed as a "smart" guide. As illustrated in FIG. 19, an exemplary tubular member comprises one or more signal carriers 148, such as conductive wires or optical fiber. The signal carriers 148 are available to carry signals to and from a variety of intelligent completion devices. The intelligent completion devices can be separate from or combined with member 20. In the embodiment illustrated, for example, a plurality of intelligent completion devices 150, such as gauges, temperature sensors, pressure sensors, flow rate sensors etc., are integrated into or attached to tubular member 20. The gauges/sensors are coupled to signal carriers 148 to provide appropriate output signals indicative of wellbore and production related parameters. Additionally, well treatment devices may be incorporated into the system to selectively treat, e.g. stimulate, the well. The gauges/sensors can be used to monitor well treatment in real time.

Other examples of intelligent completion devices that may be used in the connection with the present invention are valves, sampling devices, a device used in intelligent or smart well completion, temperature sensors, pressure sensors, flow-control devices, flow rate measurement devices, oil/water/gas ratio measurement devices, scale detectors, actuators, locks, release mechanisms, equipment sensors (e.g., vibration sensors), sand detection sensors, water detection sensors, data recorders, viscosity sensors, density sensors, bubble point sensors, pH meters, multiphase flow meters, acoustic sand detectors, solid detectors, composition sensors, resistivity array devices and sensors, acoustic devices and sensors, other telemetry devices, near infrared sensors, gamma ray detectors, $H_2S$ detectors, $CO_2$ detectors, downhole memory units, downhole controllers, perforating devices, shape charges, firing heads, locators, and other downhole devices. In addition, the signal carrier lines themselves may comprise intelligent completion devices as mentioned above. In one example, the fiber optic line provides a distributed temperature functionality so that the temperature along the length of the fiber optic line may be determined.

Also, a fiber optic line could be used to measure the temperature, the stress, and/or the strain applied to the tubular member during expansion. Such a system would also apply to a multilateral junction that is expanded. If it is determined, for example, that the expansion of the tubing or a portion thereof is insufficient (e.g., not fully expanded), a remedial action may be taken. For example, the portion that is not fully expanded may be further expanded in a subsequent expansion attempt.

Depending on the type of completion and deployment system, signal carriers 148 and the desired instrumentation and/or tools can be deployed in a variety of ways. For example, if the signal carriers, instrumentation or tools tend to be components that suffer from wear, those components may be incorporated with the completion and/or deployment system. In one implementation, instruments are deployed in or on the tubular member and coupled to signal carriers attached to or incorporated within the completion and deployment system. The coupling may comprise, for example, an inductive coupling. Alternatively, the instrumentation and/or tools may be incorporated with the completion and designed for communication through signal carriers deployed along or in the tubular member 20. In other embodiments, the signal carriers as well as instrumentation and tools can be incorporated solely in either the tubular member 20 or the completion and deployment system. The exact configuration depends on a variety of application and environmental considerations. Also, the tubular member 20 can be designed for removal from the wellbore to, for example, facilitate retrieval of gauges, sensors or other intelligent completion devices.

Tubular member 20 may be inserted into a wellbore in its contracted state via a reel similar to reel 86 used for coiled tubing. The use of a reel is particularly advantageous when relatively long sections of tubular member 20 are introduced into wellbore 26. With coiled tubing-type reel designs, the tubular member is readily unrolled into wellbore 26 or, potentially, retrieved from wellbore 26.

It should be understood that the foregoing description is of exemplary embodiments of this invention, and that the invention is not limited to the specific forms shown. For example, hydraulic fracturing or other fracturing processes may be utilized; the tubular member may be made in various lengths and diameters; the tubular member may be designed with differing degrees of expandability; a variety of completion components may be deployed within the tubular member; the tubular member may comprise or cooperate with a variety of tools and instrumentation; and the mechanisms for expanding the tubular member may vary, depending on the particular application and desired design characteristics. These and other modifications may be made in the design and arrangement of the elements without departing from the scope of the invention as expressed in the appended claims.

What is claimed is:

1. A method of stimulating production of fluid from a formation, comprising:

deploying a tubular member having transverse openings within a wellbore in a contracted state;

expanding the tubular member at a desired location within the wellbore; and fracturing the formation by applying pressure through the transverse openings.

2. The method as recited in claim 1, further comprising inserting a completion string into the tubular member.

3. The method as recited in claim 2, wherein inserting comprises inserting a sand screen.

4. The method as recited in claim 2, further comprising expanding the completion string.

5. The method as recited in claim 1, wherein fracturing comprises hydraulic fracturing.

6. The method as recited in claim 1, wherein fracturing comprises pumping a liquid through the expanded openings.

7. The method as recited in claim 1, wherein expanding comprises moving an expansion tool through the tubular member prior to inserting a final completing string.

8. The method as recited in claim 1, further comprising inhibiting axial flow of fluid along the tubular member.

9. The method as recited in claim 8, wherein inhibiting axial flow comprises inhibiting axial flow of fluid between the tubular member and a final completion string.

10. The method as recited in claim 1, wherein deploying comprises locating the tubular member in a lateral wellbore.

11. The method as recited in claim 1, wherein deploying comprises deploying a plurality of tubular members.

12. The method as recited in claim 11, wherein fracturing comprises fracturing the formation at a plurality of zones.

13. A method of utilizing a wellbore disposed within a formation, comprising:

providing an expandable tubular with transverse openings;

locating the expandable tubular within the wellbore;

enlarging the expandable tubular to reduce annular space surrounding the expandable tubular and to enlarge the transverse openings; and fracturing the formation.

14. The method as recited in claim 13, further comprising inserting a completion string within expandable tubular.

15. The method as recited in claim 14, further comprising inhibiting axial flow of fluid along the expandable tubular.

16. The method as recited in claim 14, further comprising expanding the completion string.

17. The method as recited in claim 13, wherein fracturing comprises hydraulic fracturing.

18. The method as recited in claim 13, wherein fracturing comprises pumping a liquid through the transverse openings.

19. The method as recited in claim 13, wherein locating comprises locating the expandable tubular at a lateral region of the wellbore.

20. The method as recited in claim 13, wherein locating comprises locating the expandable tubular at a vertical region of the wellbore.

21. The method as recited in claim 13, wherein enlarging comprises expanding the expandable tubular against the formation.

22. A system for enhancing production of fluid from a formation, comprising:

an expandable tubular disposed at a wellbore location in an expanded state, the expandable tubular having a plurality of transverse openings exposing an interior of the expandable tubular to the formation; and a fracturing system disposed in the interior of the expandable tubular.

23. The system as recited in claim 22, wherein the fracturing system comprises a hydraulic fracturing system.

24. The system as recited in claim 23, wherein the expandable tubular is formed from a steel material.

25. The system as recited in claim 22, further comprising a completion string insertable into the interior of the expandable tubular.

26. The system as recited in claim 25, wherein the completion string is expandable.

27. A system of enhancing production from a formation, comprising:

means for providing a plurality of preformed transverse openings in a tubular member expanded at a desired location within a wellbore; and means for hydraulically fracturing the formation by applying pressure through the plurality of preformed transverse openings.

28. The system as recited in claim 27, wherein the means for providing comprises a plurality of expandable openings.

29. The system as recited in claim 28, wherein the means for hydraulically fracturing comprises a hydraulic fluid.

* * * * *